United States Patent [19]

Weingart

[11] Patent Number: 4,928,595

[45] Date of Patent: May 29, 1990

[54] REVERSE SLAPPER DETONATOR

[75] Inventor: Richard C. Weingart, Livermore, Calif.

[73] Assignee: The United States of America as represented by the United States Department of Energy, Washington, D.C.

[21] Appl. No.: 186,527

[22] Filed: Apr. 27, 1988

[51] Int. Cl.[5] ..... F42B 3/12

[52] U.S. Cl. ..... 102/202.7; 102/202.5

[58] Field of Search ..... 102/202.5, 202.7, 202.14

[56] References Cited

U.S. PATENT DOCUMENTS

| | | | |
|---|---|---|---|
| 3,669,022 | 6/1972 | Dahn et al. | 102/202.7 |
| 4,471,697 | 9/1984 | McCormick et al. | 102/202.5 |
| 4,602,565 | 7/1986 | MacDonald et al. | 102/202.7 |
| 4,788,913 | 12/1988 | Stroud et al. | 102/202.5 |

OTHER PUBLICATIONS

Stroud, John R. "A New Kind of Detonator–The Slapper"; UCRL–77639, Feb. 1976.

*Primary Examiner*—Charles T. Jordan

*Attorney, Agent, or Firm*—Gary C. Roth; L. E. Carnahan; Judson R. Hightower

[57] ABSTRACT

A reverse slapper detonator (70), and methodology related thereto, are provided. The detonator (70) is adapted to be driven by a pulse of electric power from an external source (80). A conductor (20) is disposed along the top (14), side (18), and bottom (16) surfaces of a sheetlike insulator (12). Part of the conductor (20) comprises a bridge (28), and an aperture (30) is positioned within the conductor (20), with the bridge (28) and the aperture (30) located on opposite sides of the insulator (12). A barrel (40) and related explosive charge (50) are positioned adjacent to and in alignment with the aperture (30), and the bridge (28) is buttressed with a backing layer (60). When the electric power pulse vaporizes the bridge (28), a portion of the insulator (12) is propelled through the aperture (30) and barrel (40), and against the explosive charge (50), thereby detonating it.

5 Claims, 3 Drawing Sheets

REVERSE SLAPPER DETONATOR

The United States Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to slapper detonators, and more particularly to improved slapper detonators of simple design and economical construction.

The slapper detonator, as described by J. R. Stroud in Lawrence Livermore Laboratory document UCRL-77639, "A New Kind of Detonator - The Slapper", dated Feb. 27, 1976, "operates by exploding a thin metal foil, which accelerates a plastic film across a gap to impact on a high-density secondary explosive". Traditionally, the thin metal foil, or bridge, is etched from a metal film on a dielectric substrate. The plastic film is comprised of polyester such as mylar, or polyimide such as kapton, and is placed over the bridge to act as the flyer. The gap is provided by a piece of plastic shim stock with a punched hole, called a barrel, that is bonded to the flyer film. Finally, an explosive pellet is placed over the hole in the barrel.

Dahn et al in U.S. Pat. No. 3,669,022 issued June 13, 1972 disclose a thin film device for use as a fuze or fuse. A thin insulating layer is disposed between a pair of conductive layers, with one of the conductive layers and the insulating layer having pin holes within which a bridging element of low density and low specific heat metal is disposed, so as to short circuit the conductive layers. Electrical energy supplied to the conductive layers vaporizes the metal in the pin holes. An explosive is disposed in intimate contact with the low density and low specific heat metal bridging element.

McCormick et al in U.S. Pat. No. 4,471,697 issued Sept. 18, 1984 teach a bidirectional slapper detonator that comprises a bridge element sandwiched between two barrel holders, with a sapphire barrel disposed in each holder. Flyers, comprised of the base or laminate upon which the layer of copper of which the bridge element is a part is disposed, are positioned between the bridge element and each of the barrels. Initiating pellets are placed adjacent to each barrel and barrel holder. The layer of copper is folded on itself around a separated, individual circuit insulator.

MacDonald et al in U.S. Pat. No. 4,602,565 issued July 29, 1986 disclose an exploding foil detonator in which an exploding bridge shears a foil and drives a piece of that foil against an explosive to detonate it. The electric current that operates the detonator flows through the detonator along an electrical conductor foil that enters and exits the detonator via distinctly separated paths.

Even though the slapper detonator, since its inception, has become a staple component of the art of detonator science, there remains a continuing need for improved slapper detonators of simple design and economical construction.

SUMMARY OF THE INVENTION

It is, therefore, an object of the invention to provide an improved slapper detonator, and related methodology, of simple design.

Another object of the invention is to provide an improved slapper detonator, and related methodology, of economical construction.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, a detonator, adapted to be driven by an externally supplied pulse of electric power, is provided. The detonator comprises a sheetlike insulator that has two parallel, extended and continuous external surfaces, that are thinly spaced apart from one another. An edging external surface adjoins and separates the two parallel surfaces. A conductor is disposed along one of the parallel surfaces, folded around the edging surface, and then proceedingly disposed along the other parallel surface. A portion of the conductor, along one of the parallel surfaces, is fashioned into a bridge. An aperture is positioned in the conductor, on the other surface of the insulator, directly opposite to and across the insulator from the bridge. The conductor is adapted to receive and transport the driving pulse of electric power. A barrel is positioned adjacent to and in alignment with the aperture in the conductor, and an explosive charge is positioned adjacent to and in alignment with the barrel. The bridge is buttressed in the spatial region adjacent to the bridge, that is not occupied by the insulator. In use, when the driving pulse of electric power explosively vaporizes the bridge, a portion of the insulator, that is adjacent to the bridge, is propelled through the aperture in the conductor, through the barrel, and against the explosive charge, thus detonating it.

Preferably, the insulator of the detonator is comprised of a material selected from the group consisting of polyimide and polyester and has a thickness in the approximate range extending from 0.0005 to 0.002 inch.

It is also frequently preferred that the detonator bridge be buttressed by sandwiching the portion of the conductor that comprises the bridge, between the insulator and a backing layer comprised of a material selected from the group consisting of plastic and ceramic and having a thickness in the approximate range extending from 0.005 to 0.020 inch.

In a further aspect of the present invention, in accordance with its objects and purposes, an explosive charge may be detonated by the inventive method of disposing a conductor along an extended and continuous external surface of a sheetlike insulator, folding the conductor around the edging external surface of the insulator, and then further disposing the conductor along the other extended and continuous external surface of the insulator. The two extended and continuous external surfaces of the insulator are parallel to and thinly spaced apart from one another, and the edging external surface adjoins and separates the two parallel surfaces. The method further comprises fashioning a bridge from a portion of the conductor that is disposed along one of the parallel, external surfaces of the insulator. Another step of the method is positioning an aperture within the conductor that is located on the other parallel surface of the insulator, with the aperture located directly opposite to and across the insulator from the bridge. The method then further comprises placing a barrel adjacent to and in alignment with the aperture in the conductor; situating an explosive charge adjacent to and in alignment with the barrel; and buttressing the bridge in the spatial region adjacent to the bridge, that is not occupied by the insulator. Then, the explosive charge is detonated by transporting a pulse of electric power along the conductor. This step of the method explosively vaporizes the bridge, thus causing a portion of the insulator that is adjacent to the bridge to be propelled through the aperture in the conductor, through the barrel, and against the explosive charge, thereby initiating the afore-mentioned detonation.

Preferably, the buttressing step of this inventive method is performed by sandwiching the portion of the conductor that comprises the bridge, between the insulator and a layer of backing material.

The benefits and advantages of the present invention, as embodied and broadly described herein, include, inter alia, the provision of an improved slapper detonator, and related methodology, of simple design and economical construction.

BRIEF DESCRIPTION OF THE DRAWINGS

The accompanying drawings, which are incorporated into and form a part of the specification, illustrate an embodiment of the invention and, together with the description, serve to explain the principles of the invention. In the drawings.

DETAILED DESCRIPTION OF THE INVENTION

Figure 1:
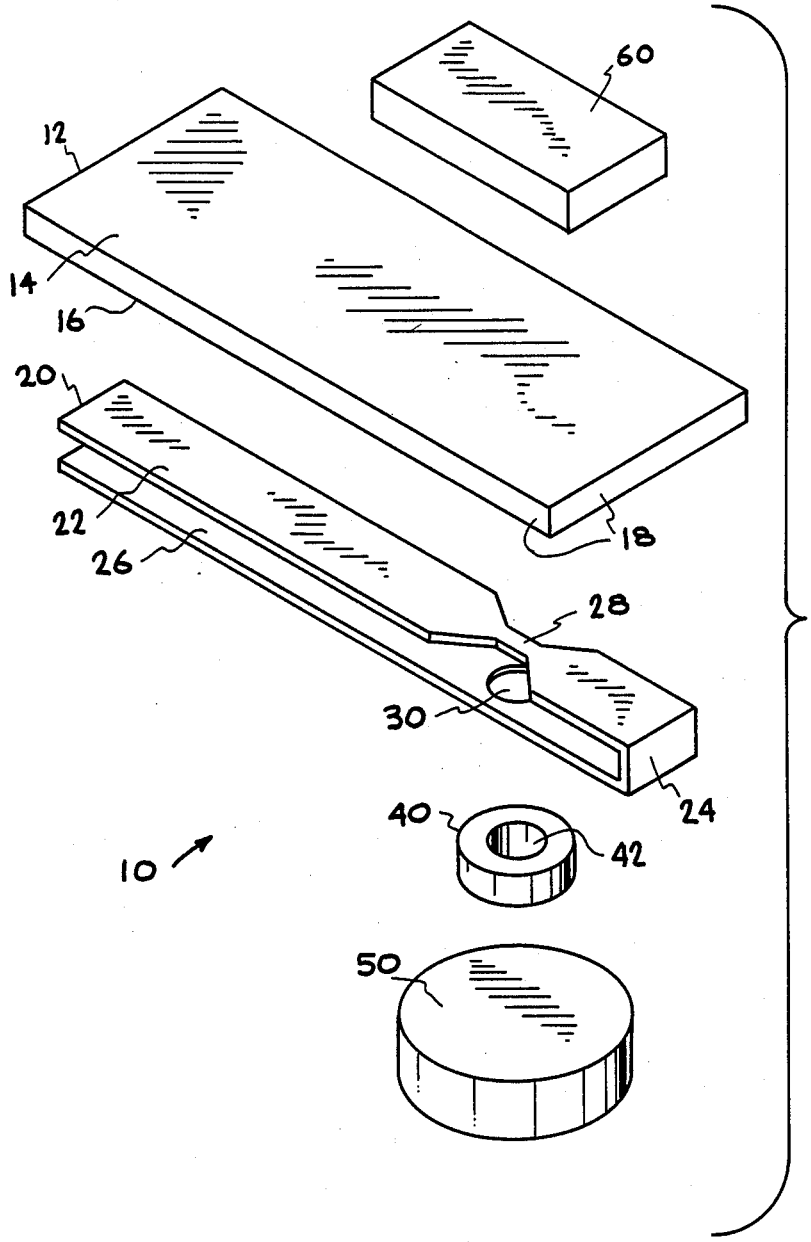
FIG. 1 is an exploded view of a detonator, made in accordance with the invention.

Reference will now be made in detail to the present preferred embodiment of the invention, an example of which is illustrated in the accompanying drawings. Reference is first made to FIG. 1, which provides an exploded view of an assemblage of detonator parts 10, that are in accordance with the invention. A sheetlike insulator 12, has a first extended and continuous external surface 14 and a second extended and continuous external surface 16, with surfaces 14 and 16 parallel to and thinly spaced apart from one another. Surfaces 14 and 16 are shown as the top and the bottom, respectively, of insulator 12. An edging external surface 18 adjoins and separates surfaces 14 and 16. Insulator 12 is shown shaped as a rectangular parallelepiped, and even though this simple shape is often advantageous, it is not an absolute requirement and insulators having many other shapes may be used in the efficacious practice of this invention. It is often preferable that insulator 12 be comprised of a material selected from the group consisting of polyimide and polyester and have a thickness in the approximate range extending from 0.0005 to 0.002 inch.

Assemblage 10 further comprises a conductor 20. When assembled, a top component 22 of conductor 20 is intended for disposal along a path that proceeds along first surface 14 of insulator 12. A side component 24 of conductor 20 is intended to fold around edging external surface 18 of insulator 12, and a bottom component 26 of conductor 20 is intended to proceed along second surface 16 of insulator 12. A bridge 28 is comprised of a portion of top component 22 of conductor 20. A bridge, as is well known in the art of detonator science, is an element of relatively high resistance within a conductor, that may be explosively vaporized in use by a driving pulse of electric power. An aperture 30 is positioned directly across from bridge 28, within the bottom component 26 of conductor 20. As apparent from FIG. 1, conductor 20 is adapted to receive and transport a pulse of electric power along its path. Conductor 20 may be comprised of copper, aluminum or any other solid conducting material. In assembly, conductor 20 may be attached to insulator 12 by any suitable method, such as, for example, by gluing or direct vapor or electro deposition.

A barrel 40, having a tube-like shape and including a bore 42, is shown as an additional detonator part of assemblage 10. Barrel 40 is adapted to be positioned adjacent to and in alignment with aperture 30 of conductor 24. In assembly, barrel 40 may be attached to conductor 20 by any appropriate means such as, for example, by gluing or, if a metal, by soldering. The material from which barrel 40 is comprised is not critical to the practice of this invention, and may include structural metals, ceramics, plastics, and the like.

As further shown in FIG. 1, an explosive charge 50 is adapted for positioning adjacent to and in alignment with barrel 40. Consonant with its potentially hazardous nature, explosive charge 50 may be attached to barrel 40 by any appropriate means, such as by gluing. Although shown as a right-circular cylinder, explosive charge 50 is not limited with respect to volumetric shape. Further, even though explosive charge 50 may comprise any material that is detonable by shock, charge 50 will frequently comprise a small piece of relatively sensitive high-explosive, and be intended for use in detonating a much larger charge of relatively insensitive explosive, not shown, to which it is more or less adjacently disposed.

The final detonator part of assemblage 10, shown in FIG. 1, is a backing layer 60, that provides a means for buttressing bridge 28 in the region of space that is adjacent to bridge 28 but not occupied by insulator 12. Since the essential function of backing layer 60 is to provide inertial mass, neither its shape nor its composition are of extreme criticality to the apparatus and method of this invention. Nevertheless, it is frequently preferred that backing layer 60 be comprised of a material selected from the group consisting of plastic and ceramic and have a thickness in the approximate range extending from 0.005 to 0.020 inch. In assembly, the portion of conductor 20 that comprises bridge 28 is sandwiched between insulator 12 and backing layer 60.

Figure 2:
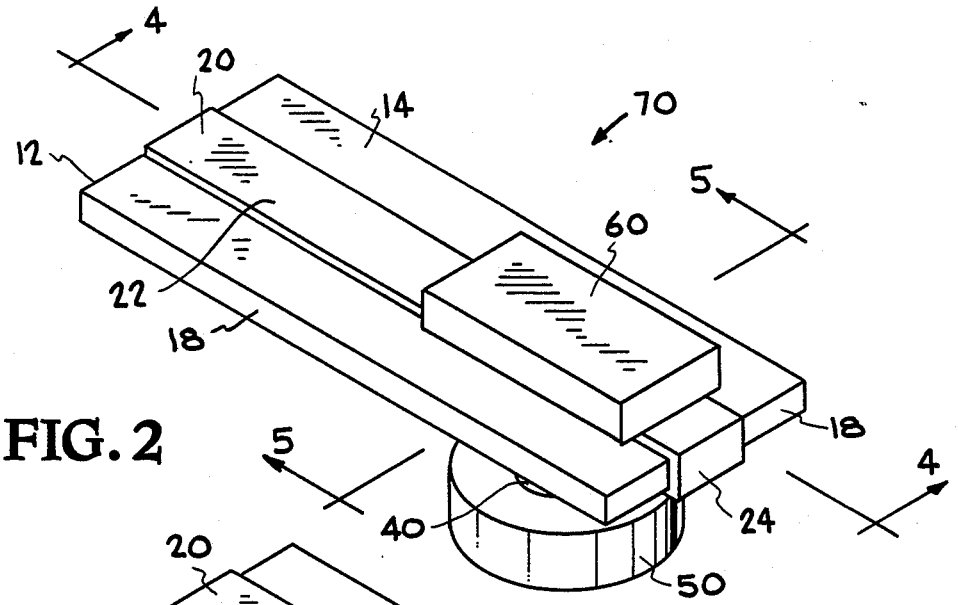
FIG. 2 is a perspective view of an assembled detonator, made in accordance with the invention.
Figure 3:
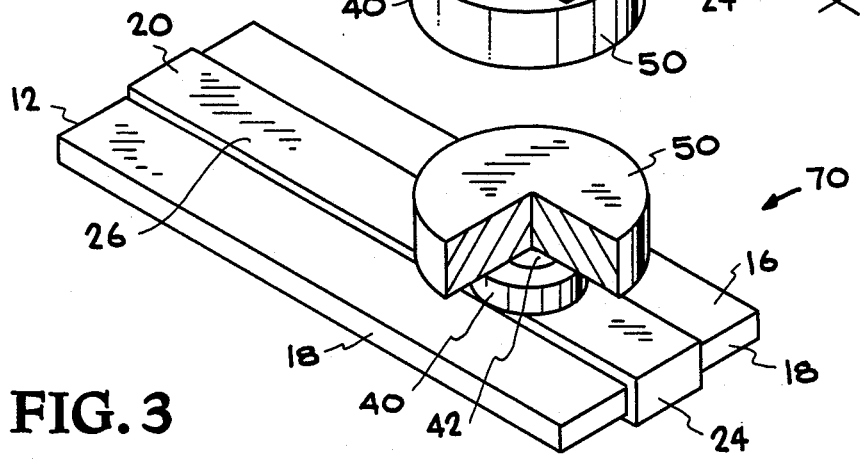
FIG. 3 is a second perspective view of the detonator of FIG. 2, showing an opposite side of the detonator from that depicted in FIG. 2.
Figure 4:
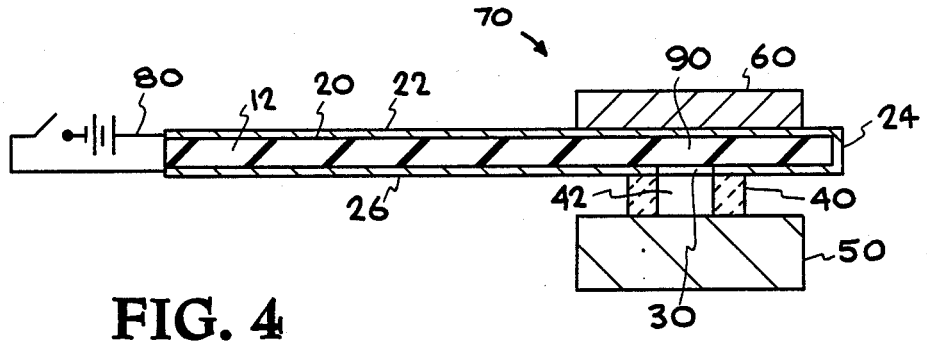
FIG. 4 is a cross-sectional side view of the detonator of FIG. 2, taken generally along line 4—4 in FIG. 2.
Figure 5:
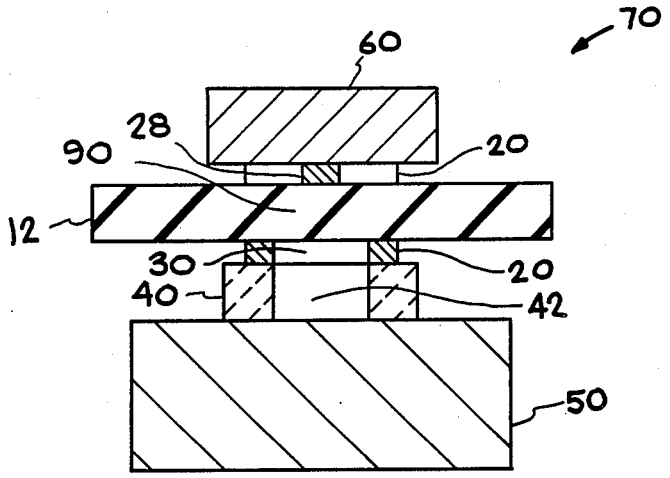
FIG. 5 is a cross-sectional front view of the detonator of FIG. 2, taken generally along line 5—5 in FIG. 2.

An assembled detonator 70, in accordance with the invention and comprised of the assemblage of detonator parts 10, shown in FIG. 1, is shown in FIGS. 2, 3, 4 and 5. The detonator 70 is comprised of insulator 12, conductor 20, barrel 40, explosive charge 50, and backing layer 60, all as described above. FIGS. 2, 3, 4 and 5 will be discussed conjointly. FIGS. 2 and 3 are perspective views of opposite sides of detonator 70, and FIGS. 4 and 5 are cross-sectional side and front views, respectively, of detonator 70 taken generally along lines 4—4 and 5—5 in FIG. 2, each of which lines passes through both bridge 28, of conductor 20, and the center of bore 42 of barrel 40. In FIG. 3, a wedge-like portion of explosive charge 50 has been cut away to expose barrel 40 and bore 42. Barrel 40 is also shown in FIGS. 2, 4 and 5, and bore 42 is also shown in FIGS. 4 and 5. The aperture 30, in conductor 20, is shown in FIGS. 4 and 5. Bridge 28 in conductor 20 is particularly pointed out in FIG. 5. The first extended and continuous external surface 14 of insulator 12 is particularly pointed out in FIG. 2; the second extended and continuous external surface 16 of insulator 12 is particularly pointed out in FIG. 3; and, the edging external surface 18 of insulator 12 is particularly pointed out in FIGS. 2 and 3. The top component 22 of conductor 20 is particularly pointed out in FIGS. 2 and 4; the bottom component 26 of conductor 20 is particularly pointed out in FIGS. 3 and 4; and, the side component 24 of conductor 20 is particularly pointed out in FIGS. 2, 3 and 4. Detonator 70 is adapted to be driven by an externally supplied pulse of electric power, as provided by an electric pulse power supply 80 that is very schematically indicated in FIG. 4. Electric pulse power supplies suitable for driving detonators, such as inventive detonator 70, are very well known in the art of detonator science. In operation, detonator 70 will function when power supply 80 provides a pulse of electric power that explosively vaporizes the bridge 28, thereby propelling a portion of insulator 12, that is adjacent to bridge 28, through aperture 30 in conductor 20, then through bore 42 in barrel 40, and then against explosive charge 50, thereby detonating explosive charge 50. The propelled portion of insulator 12 will originate from the approximate position of a location 90, shown in FIGS. 4 and 5.

It is thus appreciated that in accordance with the invention as herein described and shown in FIGS. 1 to 5, an improved slapper detonator, and related methodology, of simple design and economical construction are provided.

The foregoing description of a preferred embodiment of the invention has been presented for purposes of illustration and description. It is not intended to be exhaustive or to limit the invention to the precise form disclosed, and obviously many modifications and variations are possible in light of the above teaching The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A detonator, that is adapted to be driven by an externally supplied pulse of electric power, the detonator comprising:

a sheetlike insulator, having a first extended and continuous external surface, a second extended and continuous external surface that is parallel to and thinly spaced apart from the first surface, and an edging external surface that adjoins the first surface and the second surface and separates the first surface from the second surface;

a conductor, disposed along a path that proceeds along the first surface, then proceeds to fold around the edging surface, and then proceeds along the second surface, with a portion of the part of the conductor that is disposed along the path proceeding along the first surface comprising a bridge, with an aperture positioned within the part of the conductor that is disposed along the path proceeding along the second surface at a location that is directly across the insulator from the bridge, and with the conductor adapted to receive and transport the pulse of electric power along its path;

a barrel, positioned adjacent to and in alignment with the aperture in the conductor;

an explosive charge, positioned adjacent to and in alignment with the barrel; and means for buttressing the bridge in the spatial region adjacent to the bridge that is not occupied by the insulator;

whereby, when the pulse of electric power explosively vaporizes the bridge, a portion of the insulator adjacent to the bridge is propelled through the aperture in the conductor, then through the barrel, and then against the explosive charge, thereby detonating the explosive charge.

2. A detonator, as recited in claim 1, in which the insulator is comprised of a material selected from the group consisting of polyimide and polyester and has a thickness in the approximate range extending from 0.0005 to 0.002 inch.

3. A detonator, as recited in claim 2, in which the buttressing means comprises sandwiching the portion of the conductor that comprises the bridge between the insulator and a backing layer comprised of a material selected from the group consisting of plastic and ceramic and having a thickness in the approximate range extending from 0.005 to 0.020 inches.

4. A method for detonating an explosive charge, the method comprising the steps of:

disposing a conductor along a path that proceeds along a first extended and continuous external surface of a sheetlike insulator, then proceeds to fold around an edging external surface of the insulator that adjoins the first surface, and then proceeds along a second extended and continuous external surface of the insulator that adjoins the edging surface and that is parallel to and thinly spaced apart from the first surface, with the edging surface separating the first surface from the second surface;

fashioning a bridge from a portion of the part of the conductor that is disposed along the path proceeding along the first surface of the insulator;

positioning an aperture within the part of the conductor that is disposed along the path proceeding along the second surface of the insulator, at a location that is directly across the insulator from the bridge;

placing a barrel adjacent to and in alignment with the aperture in the conductor;

situating the explosive charge adjacent to and in alignment with the barrel;

buttressing the bridge in the spatial region adjacent to the bridge that is not occupied by the insulator; and transporting a pulse of electric power along the conductor, thereby explosively vaporizing the bridge, so that a portion of the insulator adjacent to the bridge is propelled through the aperture in the conductor, then through the barrel, and then against the explosive charge, thereby detonating the explosive charge.

5. The method of claim 4, wherein the buttressing step is carried out by sandwiching the portion of the conductor that comprises the bridge between the insulator and a backing layer of material.

* * * * *